United States Patent [19]

Blevins

[11] 4,205,840

[45] Jun. 3, 1980

[54] NET HEIGHT MEASURING SYSTEMS

[76] Inventor: Charles G. Blevins, 1728 Marlyn Dr., Little Rock, Ark. 72205

[21] Appl. No.: 942,198

[22] Filed: Sep. 14, 1978

[51] Int. Cl.[2] ..... A63B 61/00

[52] U.S. Cl. ..... 273/29 BA; 273/73 J

[58] Field of Search ..... 273/29 BA, 73 R, 73 V, 273/75

[56] References Cited

U.S. PATENT DOCUMENTS

| | | | |
|---|---|---|---|
| 494,913 | 4/1893 | Booth | 273/29 BA |
| 1,351,066 | 8/1920 | Robinson | 273/29 BA |
| 1,551,100 | 8/1925 | Graham | 273/29 BA |
| 3,549,146 | 12/1970 | Davis | 273/29 BA |

FOREIGN PATENT DOCUMENTS

| | | | |
|---|---|---|---|
| 322644 | 12/1929 | United Kingdom | 273/29 BA |

*Primary Examiner*—Richard C. Pinkham
*Assistant Examiner*—T. Brown
*Attorney, Agent, or Firm*—Stephen D. Carver

[57] ABSTRACT

A device for measuring the height of playing nets used in racquet games including tennis and the like. In a preferred form this invention comprises a generally rectangular, rigid tool adapted to be hung from the playing net and linkage of variable length which extends between the tool and a playing racquet. Net height is measured by suspending the playing racquet from the net so that the racquet touches the playing surface.

7 Claims, 4 Drawing Figures

Fig. 1.
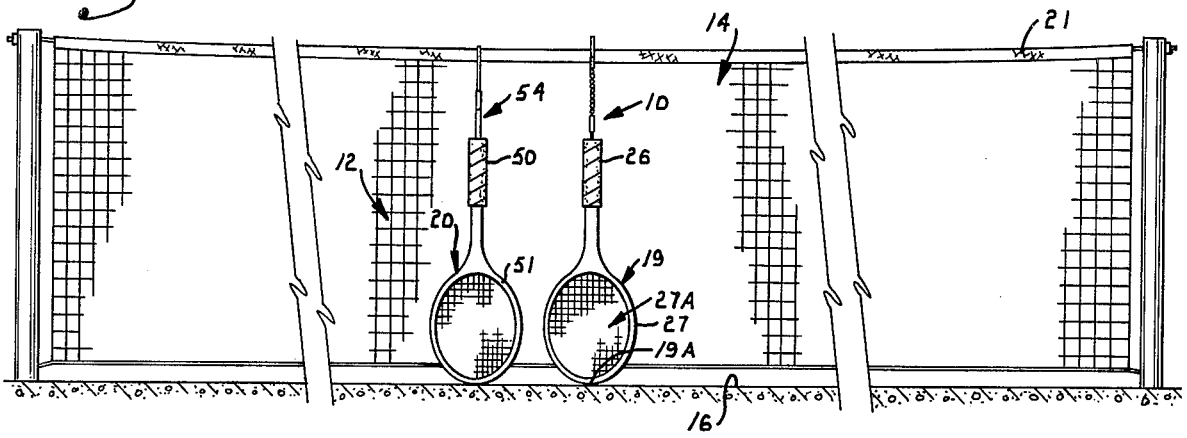
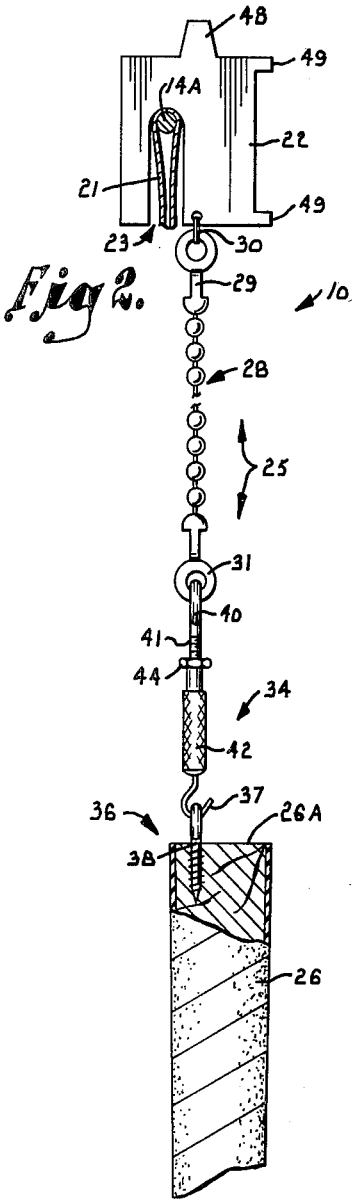
Fig 2.
Fig. 3.
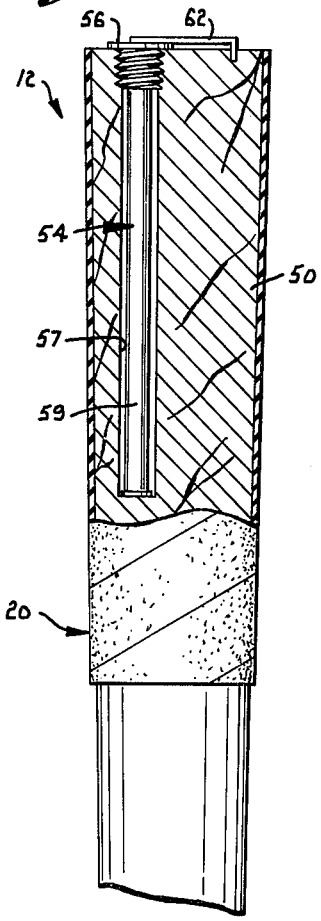
Fig. 4.
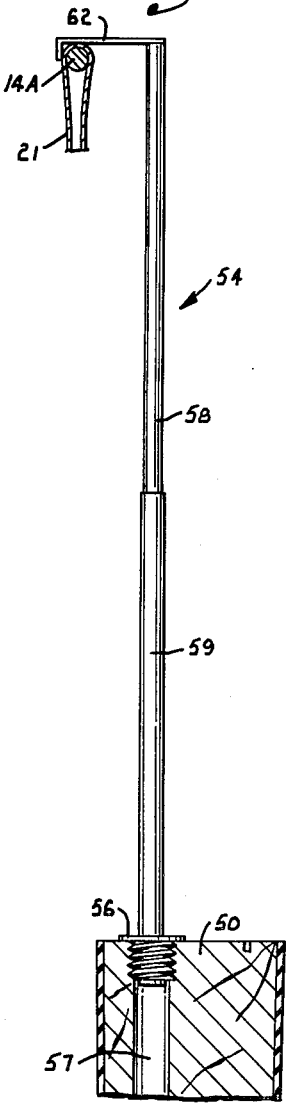

NET HEIGHT MEASURING SYSTEMS

BACKGROUND OF THE INVENTION

This invention relates to racquet game nets such as those employed in tennis, badminton or the like. More particularly, the instant invention sets forth structure adapted to utilize the playing racquet to measure and adjust the height of the playing net.

In a variety of games such as tennis and badminton, for example, a playing net is disposed between the players. According to rules of the International Lawn Tennis Federation, the tennis court is in the form of a rectangle, 78 feet long and 27 feet wide, divided across the middle by a playing net. The net is suspended by a cord or metal cable approximately ⅓ of an inch diameter, the ends of which must be attached to or pass over top posts, each of which are preferably three feet six inches high. According to the rules, the height of the tennis net shall be three feet at the center, and a band for covering the cord or metal cable and the top of the net of approximately two to two and one half inches in width is preferred.

As will be readily appreciated by most amateur tennis players, the playing nets found at most tennis facilities may be in very poor condition, and seldom will be maintained at the correct playing height. In order to measure net height a yardstick, taperule or the like may conventionally be employed by the player if he happens to have such equipment along. With such equipment it is desirable to have at least two players in order to set net height—one player to stand at the middle of the net with the measuring device, and the other to adjust the cable by rotating a ratchet or other suspension device to adjust the net to the proper height.

Prior art structure for measuring the height of playing nets is shown in U.S. Pat. Nos. 1,351,066; 1,551,100; and 3,549,146. Typical prior art structure employs substantially rigid structure which extends vertically upwardly at the middle of the net and which must be attached or secured to separate structure secured to or disposed below the net within the playing surface. Therefore, structure of the latter character must be installed semi-permanently on the playing court itself. Where not provided by the owner of the court, the player simply cannot use such structure. U.S. Pat. No. 494,913 discloses a tennis fork adapted to be set into the ground to maintain a net in proper position for lawn play.

SUMMARY OF THE INVENTION

The present invention comprises systems associated with a playing racquet for utilizing the racquet itself to measure the height of the playing net.

In a preferred form of this invention the measuring device comprises a preferably rigid and slotted tool adapted to be attached to the playing net and associated linkage which extends between the tool and is adapted to be coupled to the end of the playing racquet. When the tool suspends the racquet from the net, playing net height will be properly adjusted when the lower portion of the racquet touches the playing surface. To this effect the linkage is provided with means whereby linkage length may be varied to adjust the total length between the tool and the bottom of the racquet suspended thereby to approximately thirty-six inches as required by the previously discussed tennis rules. In an alternative form of this invention a playing racquet is described in which a handle portion thereof includes an extensible member which is normally received within the handle when the racquet is used in play. The extensible member may be telescoped outwardly from the handle and secured to the net to thereby suspend the playing racquet from the net to measure net height.

Thus an object of this invention is to provide a system associated with a racquet whereby net neight can be conveniently measured by a player.

Another object of this invention is to provide a system whereby a tennis net may be quickly and easily adjusted by a single tennis player utilizing his racquet.

A similar object of this invention is to provide means whereby a playing racquet may be used to adjust the net playing height.

Yet another object of this invention is to provide net measuring means of the character described which may be varied in length to accommodate the use of a wide variety of makes and models of playing racquets.

Still another object of this invention is to provide a playing racquet which also may be used to measure the height of the playing net.

These and other objects and advantages of this invention along with features or novelty appurtenant thereto will appear or become apparent in the course of the following description of the drawings.

BRIEF DESCRIPTION

In the following drawings, which form a part of the specification and which are to be construed in conjunction therewith, and in which like reference numerals have been employed throughout to indicate like parts in the various views:

FIG. 1 is a perspective view showing both embodiments of this invention in position on a playing net for measuring net height;

FIG. 2 is an enlarged perspective view of the preferred embodiment of this invention, with parts thereof broken away or shown in section for clarity;

FIG. 3 is a sectional view of an alternative embodiment of this invention, in which the telescoping structure thereof is illustrated in a playing position retracted within the racquet handle; and FIG. 4 is a perspective view with parts thereof broken away for clarity showing the structure of FIG. 3 in an extended position for measuring net height.

DETAILED DESCRIPTION OF THE DRAWING

Referring initially to FIG. 1, a first embodiment 10 and a second embodiment 12 of the present invention are illustrated in position on a playing net 14 to measure the height thereof above a playing surface 16. As mentioned previously, rules of tennis require that the height of the net shall be three feet at the center. Most tennis racquets vary in length between 26.5 and 27.5 inches. Therefore the total length of device 10 plus the length of racquet 19 must measure 36 inches. Net 14 may comprise an upper strip 21 of approximately 2.0–2.5 inches in width, as required by the rules of tennis. When the instant invention is suspended from a playing net so that the lower portion 19A of the tennis racquet lightly contacts the playing surface 16, the playing net 14 will be properly adjusted in height.

Referring now to FIG. 2, embodiment 10 is shown in detail. The multi purpose net measuring device 10 preferably comprises a rigid preferably metallic tool or plate 22 of generally rectangular dimensions which comprises an elongated slot 23 for engagement with the net 14. As illustrated, slot 23 has been positioned over net suspension cable 14A to suspend the racquet 19 from the playing net.

Linkage means 25 is coupled to tool 22 and extends between the tool and the tennis racquet handle 26. The linkage means preferably comprises an elongated "bead" chain 28, which comprises a link 29 attached to tool 22 via a split ring 30, and a second link 31 coupled to a linkage adjustment means 34. Chain 28 preferably comprises approximately 3/16 inch bead chain available from Ball Chain Manufacturing Company, 741 S. Fulton Avenue, Mt. Vernon, N.Y. 10550. The slot 23 is preferably of 5/16 inch width to accommodate the nominally ⅛ inch diameter of net cable 14A.

Linkage length adjustment means 34 preferably comprises a barrel coupling employed in bicycle gear changing linkage. A first coupling 36, nominally taking the form of a hook 37 is adapted to engage a second coupling member 38, nominally in the form of a threaded shanked eyelet which is adapted to be screwed into (or otherwise attached to) the upper surface 26A of racquet handle 26. When hook 37 is coupled to shanked eyelet 38 it will be apparent that the tennis racquet is suspended from the net device 10. When the length of linkage means 25 is appropriately adjusted, the distance between cable 14A and the lower portion of the tennis racquet 19, which abuts playing surface 16, will be approximately 36 inches as required by the tennis rules. To vary the length of the apparatus 10 the linkage adjustment means 34 may be varied in length as discussed later or, alternatively, individual beads in chain 28 may be removed as desired.

The linkage length adjustment means 34 preferably comprises a shanked eyelet 40 (coupled to link 31) which comprises an elongated, threaded shank 41 which is threadably received within a rigid, knurled barrel 42. A nut 44 may be loosened to facilitate rotation of barrel 42, which, as will be apparent to those with ordinary skill in the art, will vary the length of linkage means 34. After the appropriate length is achieved nut 44 must be tightened to maintain adjustment means 34 in the desired semipermanent position. The length adjustment must be repeated for different tennis racquets of various lengths. If the proper dimensions cannot be reached thru adjustment of linkage means adjustment member 34, then individual beads from chain 28 may be removed.

Tool 22 preferably comprises a somewhat trapezoidally shaped integral prying nub 48 extending upwardly therefrom. Numb 48 may be used for spreading or positioning adjacent strings or webbing 27A in racquet head 27, alternatively, nub 48 may be utilized to pry off the top tab provided on vacuum packed tennis ball cans. It will be observed that tool 22 also includes a pair of spaced apart smaller dimensioned nubs or tabs 49 which may likewise be inserted into net webbing 27A, for example, to straighten out or properly arrange racquet strings after strenuous use of the racquet.

Referring now to FIG. 3, tennis racquet 20 includes handle portion 50 integral with the lower head 51 of conventional construction. Telescoping structure 54 is illustrated in a recessed position entirely within handle 50. As illustrated in FIG. 4, the structure 54 may be extended out of the handle and telescoped approximately 9 inches in length. A threaded, tubular collar 56 may be permanently affixed to handle 50 and elongated structure 54 may be slidingly received through collar 56 into or out of tubular recessed area 57 defined in handle 50. A hook 62 provided at tip of structure 54 facilitates engagement of the apparatus over net cable 14A. When the tennis racquet 20 is properly fitted with apparatus 54, head 51 thereof will just contact playing surface 16 when hook 62 suspends it from the net 14. In this manner the playing net will be properly adjusted to the 36 inch requirements. Extensible structure 54 may comprise telescoping tubular segments 58 and 59 which may be extended to the proper length, to facilitate an overall length of 36 inches. Elongated section 58 slidably engages elongated section 59. Sections 58 and 59 may be in the form of tubes positioned in slidable coaxial alignment. The lowermost portion of apparatus 54 comprises a flange to engage collar 56 to prevent separation of apparatus 54 from the racquet handle 50.

From the foregoing, it will be seen that this invention is one well adapted to attain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A multi-purpose racket game device for measuring a predetermined height of the upper end of a conventional lawn tennis and badminton net above a tennis court playing surface, said device comprising:

tool means for engaging the upper edge of the said playing net to support said device therefrom;

linkage means attached to said tool means and extending downwardly therefrom when said tool means is engaged with a said net upper edge;

first coupling means adapted to be attached to the free end of a conventional lawn tennis and badminton racket handle; and second coupling means fastened to said linkage means for engaging said first coupling means, the length of a said racquet, said tool means, said linkage means and said first and second coupling means being combined to represent said prescribed height to thereby suspending said racquet from a said net.

2. The combination as defined in claim 1 wherein said linkage means comprises adjustment means whereby the length of said device may be selectively varied, thereby adapting said device for use with playing racquets of varying lengths said adjustment being functional for adjusting said device to allow adjustment to said prescribed height.

3. The combination as defined in claim 2 wherein said first coupling means comprises a shank and eye means, said shank being threaded and adapted to be screwed into the handle of a said racquet and said second coupling means comprises a shank and hook means, said shank of said second coupling means being attached to said linkage length adjustment means and said hook being attached to said eye of said first coupling means.

4. The combination as defined in claim 3 wherein said length adjustment means comprises:

a threaded barrel member, said shank of said second coupling means being attached at one end thereof;

a third coupling means, said third coupling means having an eye and a threaded shank, said shank of said third coupling means being threadably received by said barrel member at the opposite end thereof whereby said length varying means may be adjusted by rotating said third coupling means with respect to said barrel member; and nut means threadably received on said threaded shank for securing said third coupling means in a desired semipermanent position with respect to said barrel member.

5. The combination as defined in claim 2 wherein said tool means comprises a plurality of nubs for selectively adjusting the spacing between adjacent strings of a lawn tennis and badminton racquets.

6. The combination as defined in claim 5 wherein said tool means comprises an elongated slot for engaging the upper edge of a said net when said device is suspended from a said playing net.

7. The combination as defined in claim 2 wherein said tool means comprises prying means for removing the lid of a can of playing balls.

* * * * *